US011473521B1

(12) United States Patent
Kessens

(10) Patent No.: US 11,473,521 B1
(45) Date of Patent: Oct. 18, 2022

(54) METHODS OF FORMING A THERMALLY ISOLATED EXHAUST PORT

(71) Applicant: Deere & Company, Moline, IL (US)

(72) Inventor: Jeremy M. Kessens, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 17/305,827

(22) Filed: Jul. 15, 2021

(51) Int. Cl.

| | |
|---|---|
| ***B22D 15/02*** | (2006.01) |
| ***F02F 1/26*** | (2006.01) |
| ***F02F 1/42*** | (2006.01) |
| ***B22D 27/00*** | (2006.01) |
| ***B22D 19/00*** | (2006.01) |

(52) U.S. Cl.
CPC ..... *F02F 1/26* (2013.01); *B22D 15/02* (2013.01); *B22D 19/0009* (2013.01); *B22D 27/003* (2013.01); *F02F 1/4264* (2013.01)

(58) Field of Classification Search
CPC .. B22D 15/02; B22D 19/0009; B22D 27/003; B22D 25/02; B22D 27/00; B22D 27/04; B22D 27/20
See application file for complete search history.

(56) References Cited

U.S. PATENT DOCUMENTS

2014/0161657 A1 6/2014 Lee et al.
2019/0376465 A1* 12/2019 Bilancia ..... B22D 19/0009

FOREIGN PATENT DOCUMENTS

WO WO2001018375 A1 3/2001

* cited by examiner

*Primary Examiner* — Kevin P Kerns
*Assistant Examiner* — Steven S Ha

(57) ABSTRACT

A method of forming a thermally isolated exhaust port, the method comprising placing a chill device around an exhaust port core in a mold for an engine cylinder head, forming the engine cylinder head with an exhaust port using a casting process, generating, in the cylinder head with the exhaust port during the casting process, nodular graphite iron proximate the chill device around the exhaust port core, and forming the thermally isolated exhaust port containing nodular graphite iron in the cylinder head.

2 Claims, 6 Drawing Sheets

METHODS OF FORMING A THERMALLY ISOLATED EXHAUST PORT

TECHNICAL FIELD

The present disclosure generally relates to combustion engines. An embodiment of the present disclosure relates to an engine for utility vehicles.

BACKGROUND

Utility vehicles, such as construction vehicles and agricultural vehicles, include an engine with one or more exhaust ports proximate each engine cylinder. It can be beneficial to isolate heat to prevent it from rejecting to the coolant system of the vehicle.

SUMMARY

Various aspects of examples of the present disclosure are set out in the claims.

According to a first aspect of the present disclosure, According to a first aspect of the present disclosure, a method of forming a thermally isolated exhaust port, the method comprising placing a chill device around an exhaust port core in a mold for an engine cylinder head, forming the engine cylinder head with an exhaust port using a casting process, generating, in the cylinder head with the exhaust port during the casting process, nodular graphite iron proximate the chill device around the exhaust port core; and forming the thermally isolated exhaust port containing nodular graphite iron in the cylinder head.

In another aspect of the present disclosure, a method of forming a thermally isolated exhaust port, the method comprising applying an endothermic material to an exhaust port core in a mold for an engine cylinder head, forming the engine cylinder head with an exhaust port using a casting process, generating, in the cylinder head with the exhaust port during the casting process, nodular graphite iron proximate the endothermic material around the exhaust port core, and forming the thermally isolated exhaust port containing nodular graphite iron in the cylinder head.

In another aspect of the present disclosure, method of forming a thermally isolated exhaust port, the method comprising injecting an inert gas permeate to a core surface in a mold for an exhaust port of an engine cylinder head, forming the engine cylinder head with an exhaust port using a casting process, generating, in the cylinder head with the exhaust port during the casting process, nodular graphite iron proximate the inert gas around the exhaust port core surface, and forming the thermally isolated exhaust port containing nodular graphite iron in the cylinder head.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1A:
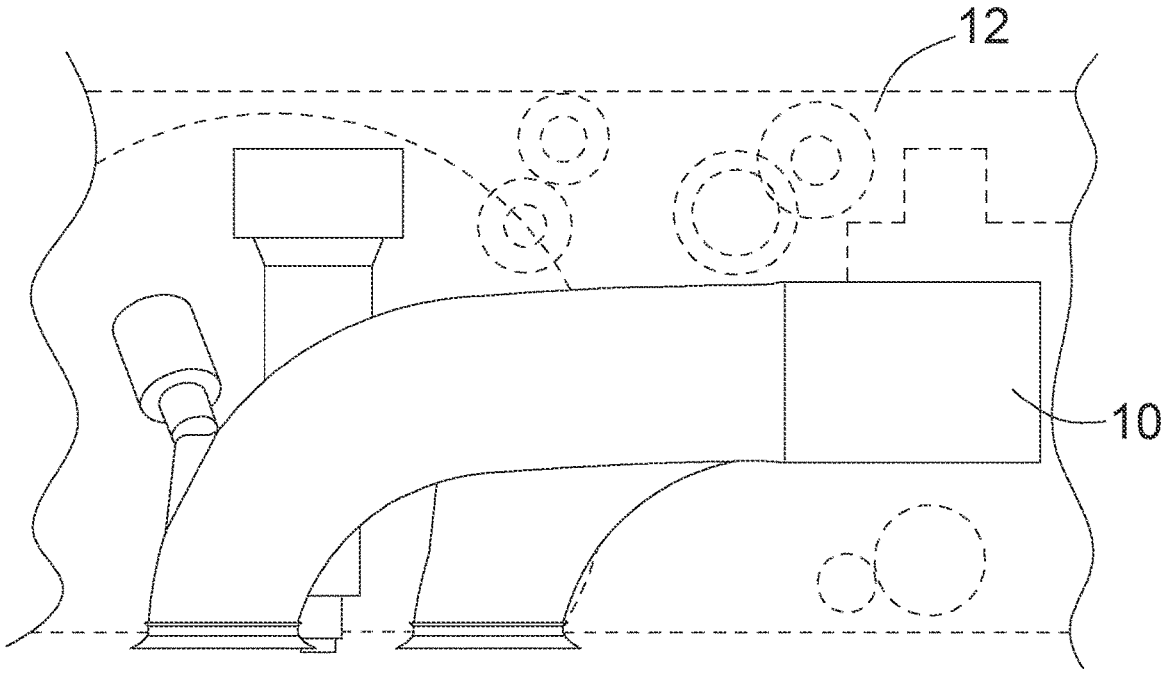
FIGS. 1A-B are orthographic views of an exemplary two valve exhaust port design, consistent with embodiments of the present disclosure.

At least one example embodiment of the subject matter of this disclosure is understood by referring to FIGS. 1 through 8 of the drawings.

While the present disclosure has been illustrated and described in detail in the drawings and foregoing description, such illustration and description is not restrictive in character, it being understood that illustrative embodiment (s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

During operation of the engine, heat is generated in each cylinder. It is desired and beneficial to dissipate the heat generated in certain areas, while isolating heat from being rejected out to the cooling system in other areas. Compacted Graphite Iron (CGI) is a type of cast iron that provides a balance between thermal and mechanical properties when compared to other typical cast irons. The size and shape of the graphite microstructure within CGI determine the thermal and mechanical properties. The formation of graphite in CGI can be manipulated to optimize its thermal behavior in specific areas of a casting. By reducing the carbon precipitation potential and promoting the formation of nodular graphite the thermal conductivity can be reduced. There is a need to form this nodular graphite iron at specific areas of an engine to gain the most benefit to isolate heat rejection. Forming nodular graphite in specific areas of an engine, including the cylinder head and related exhaust ports, requires special casting methods.

Exhaust ports generally represent 80% (or more) of the heat rejection into the coolant channels of the cylinder head, and almost 40% of the total heat rejected to the combined engine coolant system (e.g., circulated coolant through the radiator and portions of the engine block, including the cylinder head). Heat rejection into the coolant system could potentially be reduced by 15-25% just using the CGI material, and further reduced by another 10% by modifying the graphite microstructure of CGI to change the thermal conductivity of the metal around the exhaust ports during the casting process.

Figure 1B:
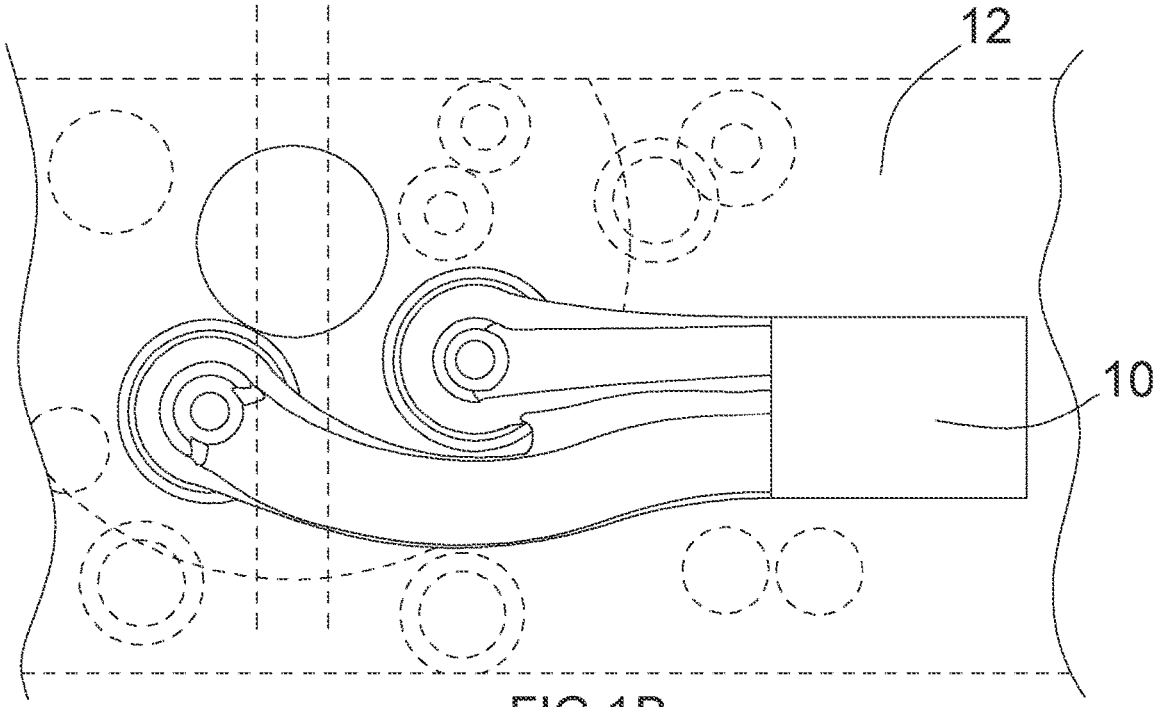

FIGS. 1A-B are orthographic views of a typical two valve exhaust port design, consistent with embodiments of the present disclosure. FIGS. 1A-B shows a portion of an exhaust port 10 coupled with a cylinder head 12 in a combustion engine (not shown).

Figure 2:
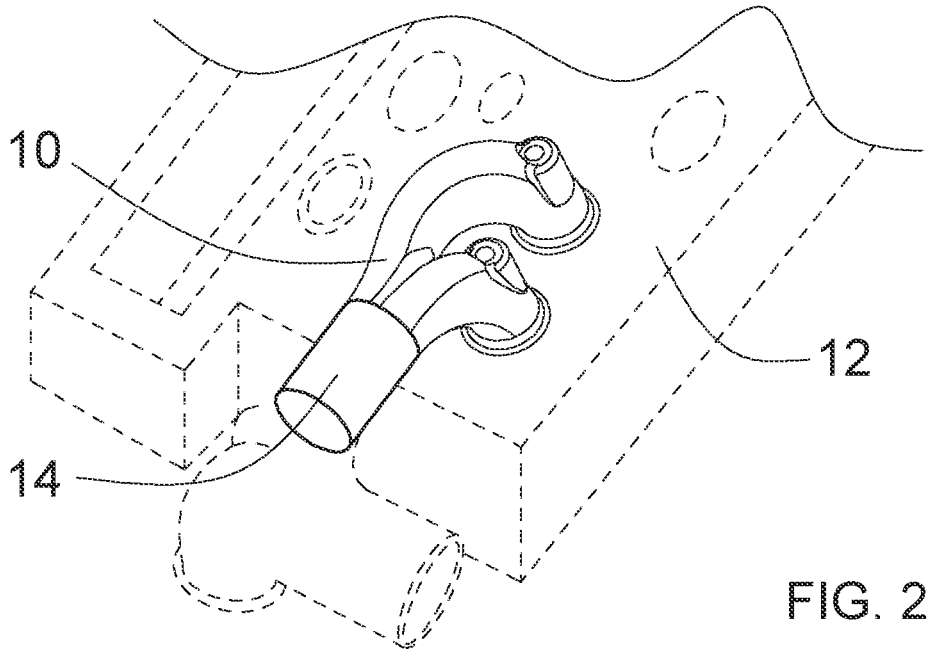
FIG. 2 is an isometric view of the exhaust port of FIG. 1, consistent with embodiments of the present disclosure.

FIG. 2 is an isometric view of a portion of the exhaust port of FIG. 1, consistent with embodiments of the present disclosure. Portions of the exhaust port where nodular graphite iron could be present to minimize thermal conductivity are indicated by the highlighted area. Having this portion of the exhaust port consist of nodular graphite iron allows for better heat isolation. The increase in heat isolation is beneficial because it reduces the amount of exhaust gas heat rejected to a cooling system for the engine (not shown). This allows the engine application to reduce the space claim and packaging size of the radiator and the cooling system. Additionally, more heat energy is conserved within the exhaust gas system for improved turbocharging efficiency.

A target area 14 of the exhaust port 10 is indicated. This is an area of the exhaust port 10 where heat isolation is beneficial to prevent, and/or limit/reduce the heat transfer from the exhaust port 10 to the coolant of the cooling system. Other areas of the exhaust port 10 are also helpful for the processes described herein as they relate to heat isolation.

Figure 3:
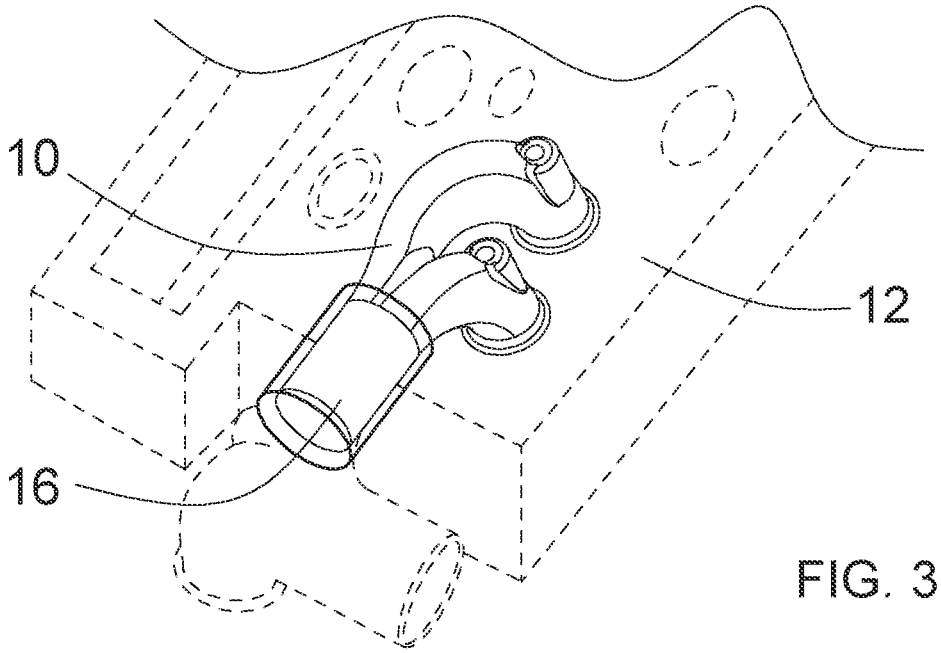
FIG. 3 is an isometric view of the exhaust port of FIG. 1 with a chill device, consistent with embodiments of the present disclosure, consistent with embodiments of the present disclosure.

FIG. 3 is an isometric view of a portion of the exhaust port of FIG. 1 with a chill device, consistent with embodiments of the present disclosure. FIG. 3 shows the placement of a sleeve 16 consisting of metal inserted over and around the exhaust port core within the casting mold to serve as a chill device.

Nodule graphite can be promoted in CGI by manipulating the cooling curve during solidification of the cast material. A faster cooling rate can reduce graphite precipitation in the cast material, which allows for more nodularity in the microstructure of the cast material. Placing a chill device around the exhaust core in a mold before the exhaust core is formed can allow for a faster cooling rate of the cast material in an area proximate the chill device, to facilitate formation of nodular graphite iron in that area. See FIG. 6 and related discussion for more information.

Figure 4:
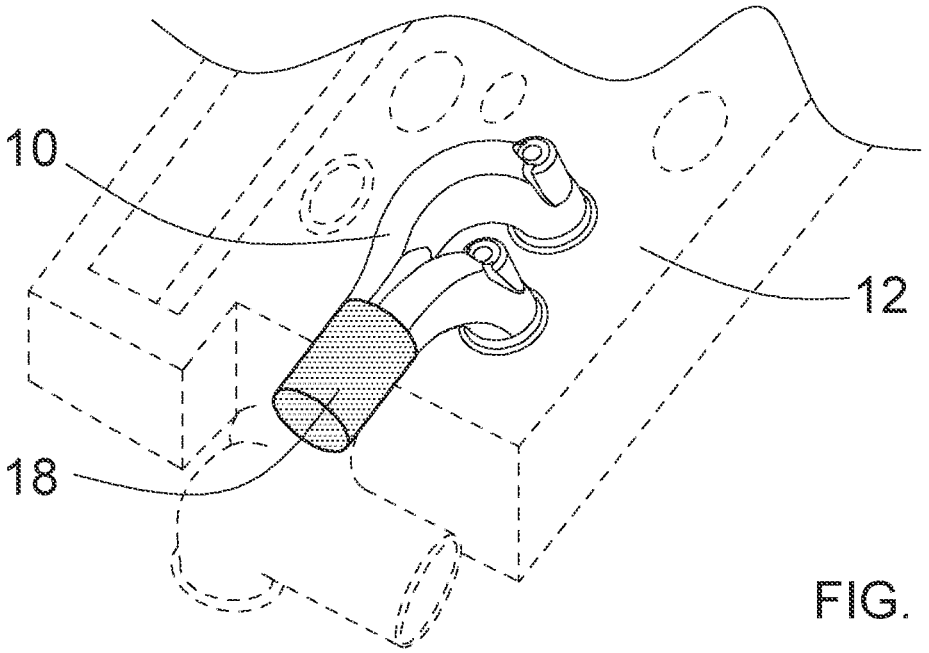
FIG. 4 is an isometric view of the exhaust port of FIG. 1 with a portion with an endothermic coating, consistent with embodiments of the present disclosure.

FIG. 4 is an isometric view of the exhaust port of FIG. 1 with an endothermic coating, consistent with embodiments of the present disclosure. FIG. 4 indicates the application of an endothermic coating applied directly to a portion of the exhaust port core. The entire exhaust port core could also be dipped or submerged in an endothermic coating allowing it to cover the entire exhaust port core for more effective results.

Another method to promote formation of nodule graphite in CGI is to apply endothermic material around the exhaust core in a mold before the exhaust core is formed, which can allow for a faster cooling rate of the cast material in an area proximate the endothermic material, to facilitate formation of nodular graphite iron in that area. See FIG. 7 and related discussion for more information.

Figure 5:
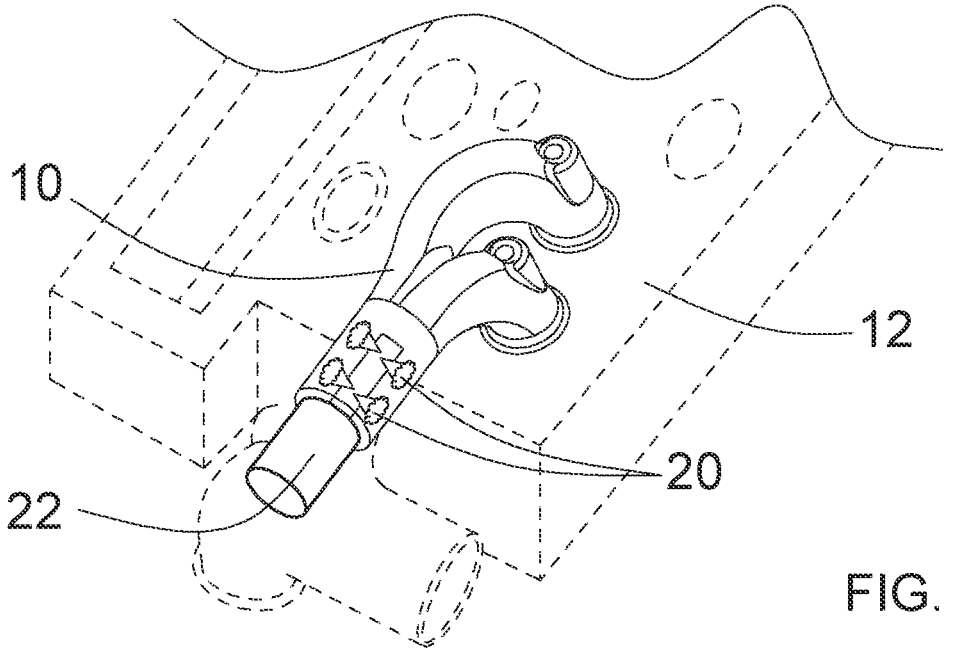
FIG. 5 is an isometric view of the exhaust port of FIG. 1 with a gas injector injecting cooling gas into the exhaust port, consistent with embodiments of the present disclosure.

FIG. 5 is an isometric view of a portion of the exhaust port of FIG. 1 with a gas injector injecting cooling gas into the exhaust port, consistent with embodiments of the present disclosure. FIG. 5 is a representation showing an inert gas 20 injected through a gas injector 22 into a hollow exhaust port core cavity allowing the inert gas 20 to permeate through the core material to the mold surface.

Yet another method to promote formation of nodule graphite in CGI is inject gas into the exhaust port core during the casting process, which can allow for a faster cooling rate of the cast material in an area proximate the endothermic material, to facilitate formation of nodular graphite iron in that area. See FIG. 8 and related discussion for more information.

Figure 6:
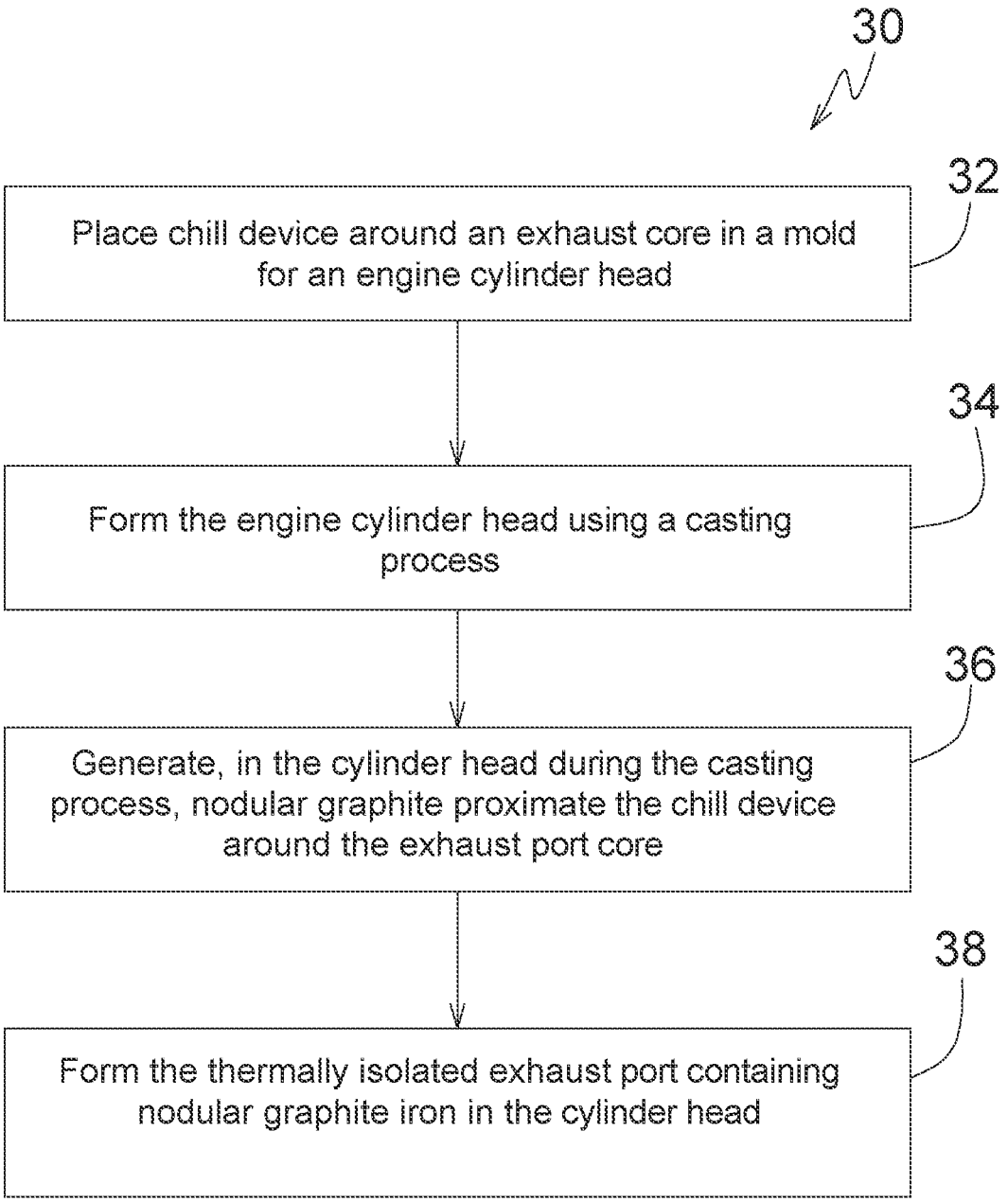
FIG. 6 is a flow diagram of a method for forming a thermally isolated exhaust port in a cylinder head; consistent with embodiments of the present disclosure.

FIG. 6 is a flow diagram of a method for forming a thermally isolated exhaust port in a cylinder head; consistent with embodiments of the present disclosure. FIG. 4 shows an embodiment of a method for forming a thermally isolated exhaust port. Process 30 includes a step 32 of placing a chill device around an exhaust core in a mold for an engine cylinder head, a step 34 of forming the engine cylinder head using a casting process, a step 36 of generating, in the cylinder head during the casting process, nodular graphite iron proximate the chill device around the exhaust port core, and a step 38 of forming the thermally isolated exhaust port containing nodular graphite iron in the cylinder head.

Nodule graphite can be promoted in CGI by manipulating the cooling curve during solidification of the cast material. A faster cooling rate can reduce graphite precipitation in the cast material, which allows for more nodularity in the microstructure of the cast material. In step 32 of FIG. 6, placing a chill device around the exhaust core in a mold can allow for a faster cooling rate of the cast material in an area proximate the chill device, to facilitate formation of nodular graphite iron in that area.

In one embodiment, the chill device can comprise a metal chill integrated into the mold. For example, a metal sleeve can be placed around the exhaust port core of the mold. The metal sleeve will allow for a faster cooling rate of the cast material in this area and promote formation of nodular graphite iron proximate the chill device (e.g., metal sleeve) as shown in FIG. 3. The chill device (i.e., chilling device, the chill, chiller device) promotes nodular iron by increasing the cooling rate of the molten iron, which reduces the graphite precipitation growth. The expelled carbon remains in nodular graphite form which does not conduct heat as well as graphite flake growth that is present in blunted (or compacted) form in CGI.

Figure 7:
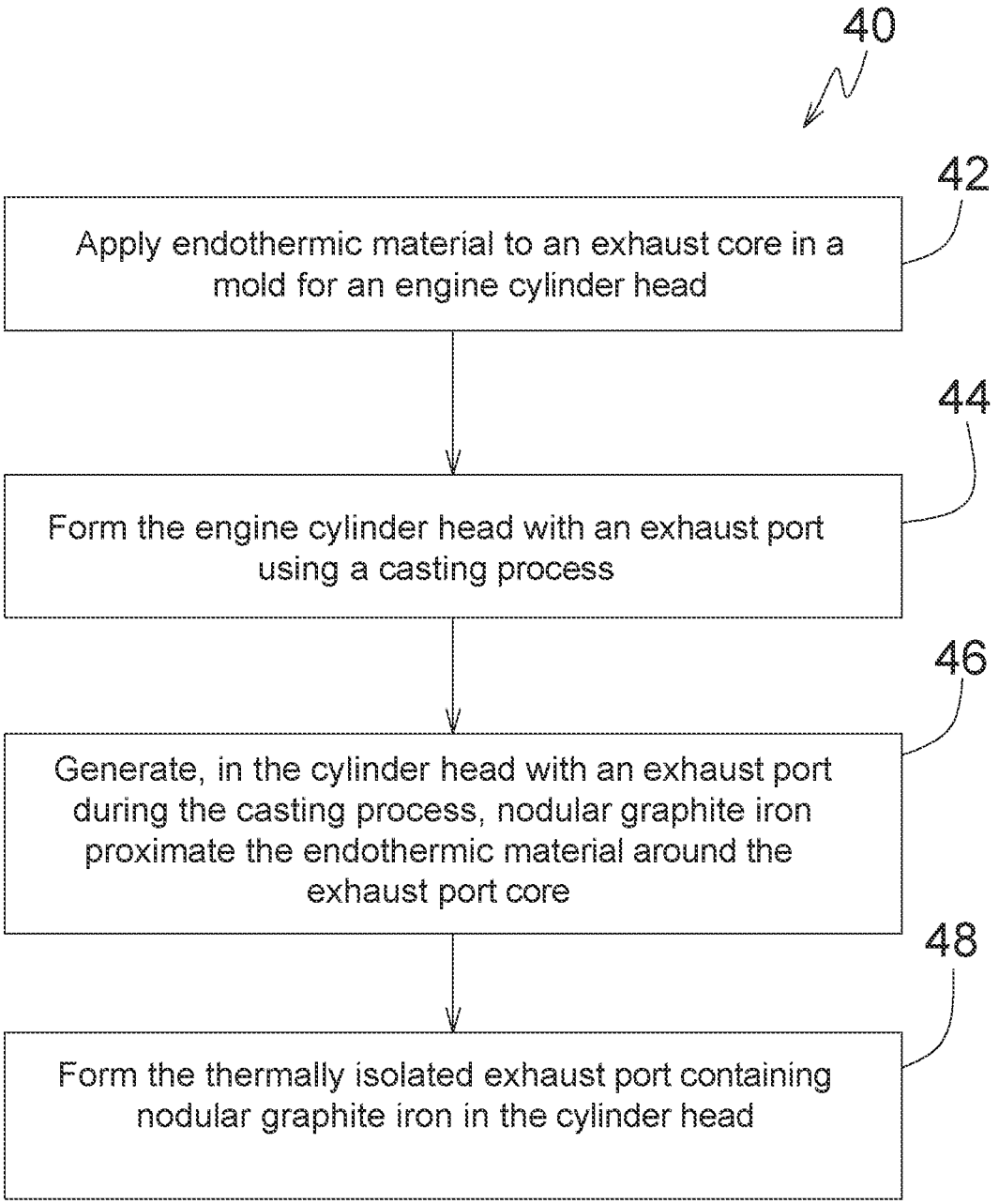
FIG. 7 is a flow diagram of a method for forming a thermally isolated exhaust port in a cylinder head; consistent with embodiments of the present disclosure; consistent with embodiments of the present disclosure.

FIG. 7 is a flow diagram of a method for forming a thermally isolated exhaust port in a cylinder head; consistent with embodiments of the present disclosure; consistent with embodiments of the present disclosure. FIG. 7 shows another embodiment of a method for forming a thermally isolated exhaust port. Process 40 includes a step 42 of applying an endothermic material around an exhaust core in a mold for an engine cylinder head, a step 44 of forming the engine cylinder head using a casting process, a step 46 of generating, in the cylinder head during the casting process, compacted graphite iron (CGI) proximate the endothermic material around the exhaust port core, and a step 48 of forming the thermally isolated exhaust port containing nodular graphite iron in the cylinder head.

As described above, nodule graphite can be promoted in CGI by manipulating the cooling curve during solidification of the cast material. A faster cooling rate can reduce graphite precipitation in the cast material, which allows for more nodularity in the microstructure of the cast material. As shown in step 42 of FIG. 7, applying endothermic material around the exhaust core in a mold can allow for a faster cooling rate of the cast material in an area proximate the endothermic material, to facilitate formation of nodular graphite iron in that area.

The endothermic material can be, for example, an endothermic paste applied to the exhaust port core. For example, the exhaust port cores could be dipped or coated in an endothermic paste to speed up the molten metal solidification process at the exhaust port core surface as shown in FIG. 4. The endothermic paste can comprise, for example, a paste containing tellurium (i.e., a tellurium paste).

Figure 8:
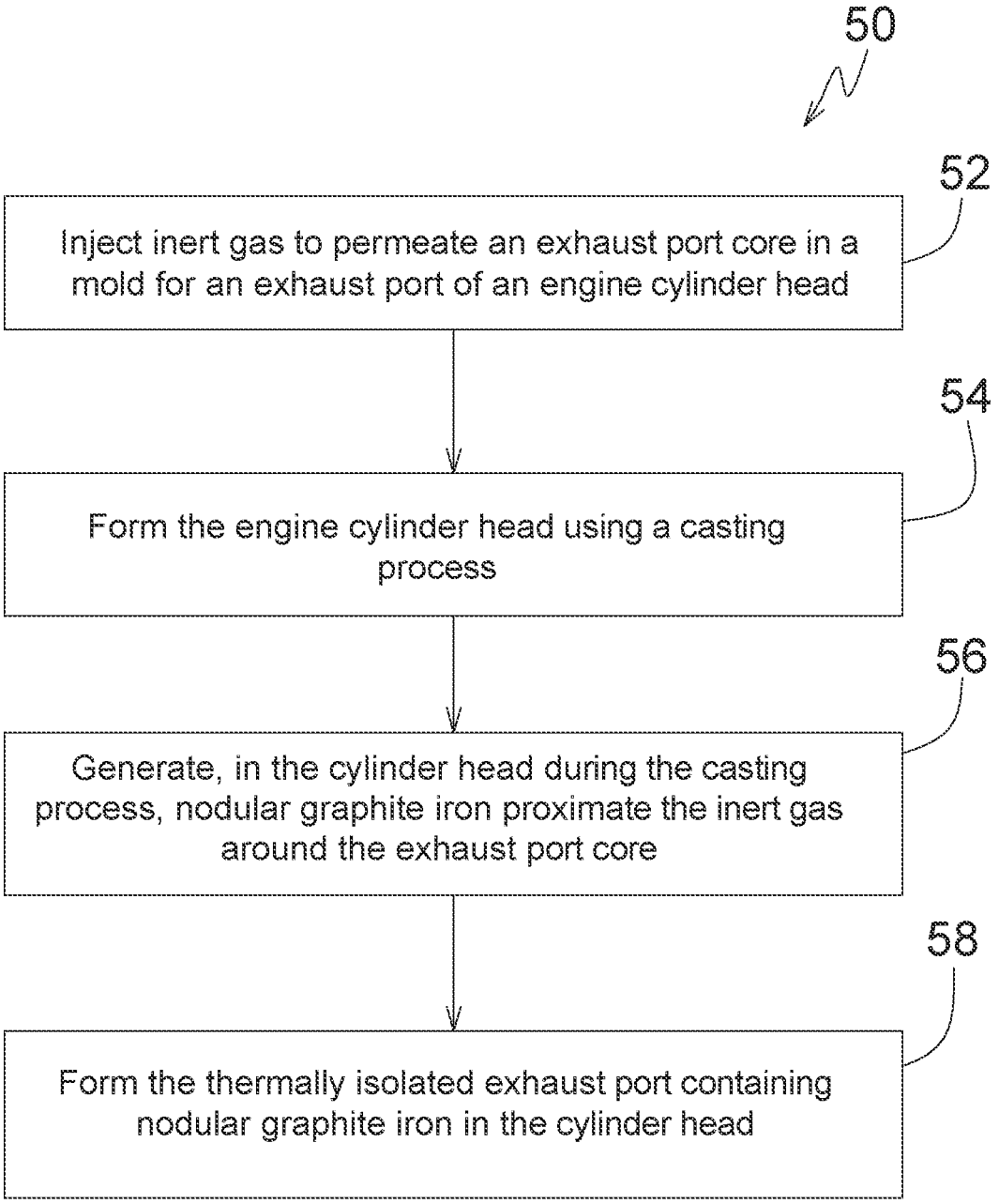
FIG. 8 is a flow diagram of a method for forming a thermally isolated exhaust port in a cylinder head; consistent with embodiments of the present disclosure.

FIG. 8 is a flow diagram of a method for forming a thermally isolated exhaust port in a cylinder head; consistent with embodiments of the present disclosure. FIG. 8 shows yet another embodiment of a method for forming a thermally isolated exhaust port. Process 50 includes a step 52 of injecting an inert gas to permeate through an exhaust port core in a mold for an engine cylinder head, a step 54 of forming the engine cylinder head using a casting process, a step 56 of generating, in the cylinder head during the casting process, nodular graphite iron proximate the inert gas around the exhaust port core surface, and a step 58 of forming the thermally isolated exhaust port containing nodular graphite iron in the cylinder head.

As described above, nodule graphite can be promoted in CGI by manipulating the cooling curve during solidification of the cast material. A faster cooling rate can reduce graphite precipitation in the cast material, which allows for more nodularity in the microstructure of the cast material. As shown in step 52 of FIG. 8, injecting an inert gas to permeate through the exhaust core in a mold can allow for a faster cooling rate of the cast material in an area proximate the inert gas, to facilitate formation of nodular graphite iron in that area.

The inert gas can be, for example, argon or nitrogen or a combination of argon and nitrogen (or other suitable inert gas(es)), injected proximate to the exhaust port core surface as shown in FIG. 5.

What is claimed is:

1. A method of forming a thermally isolated exhaust port, the method comprising:

placing a chill device around an exhaust port core in a mold for an engine cylinder head;

forming the engine cylinder head with an exhaust port using a casting process;

generating, in the cylinder head with the exhaust port during the casting process, nodular graphite iron proximate the chill device around the exhaust port core; and forming the thermally isolated exhaust port containing nodular graphite iron in the cylinder head.

2. The method of claim 1, wherein the chill device comprises a metal sleeve integrated into the mold proximate the exhaust port core.

* * * * *